US006311338B1

(12) United States Patent
Galet

(10) Patent No.: US 6,311,338 B1
(45) Date of Patent: Nov. 6, 2001

(54) ARRANGEMENT FOR MAINTAINING A PROTECTIVE HELMET

(75) Inventor: Adrien Galet, Chatillon sur Chalaronne (FR)

(73) Assignee: Gallet S.A., Chatillon sur Chalaronne (FR)

( * ) Notice: Subject to any disclaimer, the term of this patent is extended or adjusted under 35 U.S.C. 154(b) by 0 days.

(21) Appl. No.: 09/245,894

(22) Filed: Feb. 8, 1999

(30) Foreign Application Priority Data

Feb. 9, 1998 (FR) ..... 98 01867
Jul. 8, 1998 (FR) ..... 98 08972

(51) Int. Cl.[7] ..... A42B 3/08
(52) U.S. Cl. ..... 2/421
(58) Field of Search ..... 2/410, 411, 417, 2/420, 421, 425, 6.6

(56) References Cited

U.S. PATENT DOCUMENTS 2,846,683 8/1958 Dye et al. ..... 2/3
4,056,852 11/1977 Greendale ..... 2/417
4,741,054 5/1988 Mattes ..... 2/421
4,856,119 * 8/1989 Haberle ..... 2/417
5,077,839 1/1992 Keller ..... 2/421
5,121,508 * 6/1992 Grilliot et al. ..... 2/421
5,469,583 11/1995 Akeley et al. ..... 2/421
5,581,819 12/1996 Garneau ..... 2/421
5,794,272 * 8/1998 Workman et al. ..... 2/421
5,983,405 * 11/1999 Casale ..... 2/421

FOREIGN PATENT DOCUMENTS 0643933 3/1995 (EP) .
WO 94/23606 10/1994 (WO) .

* cited by examiner

*Primary Examiner*—Michael A. Neas
(74) *Attorney, Agent, or Firm*—Greenblum & Bernstein, P.L.C.

(57) ABSTRACT

A protective helmet partially formed by a main outer shell having a longitudinal plane of symmetry, and of the type having a holding and positioning arrangement adapted to allow its fastening to the user's head, the arrangement a set of flexible straps, wherein the holding and positioning arrangement has a mechanism for adjusting the length of the straps, at least one element of which is constituted by a pulley.

8 Claims, 7 Drawing Sheets

ARRANGEMENT FOR MAINTAINING A PROTECTIVE HELMET

BACKGROUND OF THE INVENTION

1. Field of the Invention

The present invention relates to a protective helmet, and more particularly to an arrangement for holding or maintaining the helmet in position on the head of the wearer, as well as to the devices for adjusting the holding arrangement, especially a chin strap.

2. Description of Background and Relevant Information

Protective helmets are known, which are used in various fields and worn by a variety of users, such as bicyclists, motorcyclists, firefighters, skiers, and others, such as soldiers, aircraft or helicopter pilots. All of the current helmets, regardless of their use, have an outer rigid shell with the general shape of a sphere including a facial opening, and whose cavity thus formed has protective and comfort padding elements adapted to nest the user's head. Furthermore, the helmet is conventionally held on the user's head by a holding arrangement, such as a flexible chin strap fixed to the lateral portions of the helmet. The current devices for connecting the chin strap are completely unsatisfactory, since they are inefficient, often unreliable, and very unaesthetic. The removal or positioning of the helmet is most often quite difficult; the adjustment thereof is delicate and often does not allow a proper positioning and retention. The helmet is then uncomfortable for the wearer, and it does not fulfil its protective function in good conditions.

Furthermore, once the helmet is positioned and tightened on the user's head, it has free strap ends that can hinder the wearer's movements.

SUMMARY OF THE INVENTION

An object of the invention is to remedy the aforementioned drawbacks with an arrangement that is simpler, more reliable and easier to implement. To this end, an object of the present invention is to reinforce the holding of the helmet while increasing the comfort for the user, by improving the adjustment and positioning of the helmet on his/her head. Moreover, it advantageously enables the elimination of all unnecessary strap portions left free by adjustments of the conventional type.

According to a main characteristic of the protective helmet according to the invention, the latter is formed by a main outer shell that has a longitudinal plane of symmetry, and is of the type having a holding and positioning arrangement adapted to allow its fastening to the user's head, this arrangement having a set of flexible straps, wherein the holding and positioning arrangement includes a system for adjusting the length of the straps, at least one element of which is constituted by a pulley, or a pulley-type element or device.

According to an embodiment of the protective helmet according to the invention, the holding and positioning arrangement includes a chin strap constituted by a set of flexible straps, the chin strap thus being constituted by a front strap and a rear strap joining one another in their middle portion, whereas the front strap is constituted by a left portion of the front strap and by a right portion of the front strap, and the rear strap is constituted by a left portion of the rear strap and by a right portion of the rear strap, the left portions being joined at a point of convergence, while the right portions are also joined at a point of convergence, the points of convergence being adapted to be connected to one another to fasten the helmet.

According to a complementary characteristic of the protective helmet according to the invention, the strap portions have a length adjustment mechanism.

According to another characteristic of the protective helmet of the invention, the adjustment mechanism for the strap is constituted by a pulley, or pulley-type element or device.

According to an alternative embodiment of the protective helmet, each pulley device is constituted by a lever buckle arranged on a strap portion, and by a complementary return buckle fixed to the main outer shell of the helmet in the area of the point where the strap portion is attached to the shell.

According to this alternative embodiment, the strap portion passes through the buckle starting from the point where it is affixed to the main outer shell, passes through a guide of the lever buckle, then comes back to pass in the complementary return buckle, before slidably passing again beneath the pivoting lever arm that is susceptible of blocking the sliding.

According to another characteristic of the protective helmet according to the invention, the set of flexible straps includes a front strap and a rear strap that is formed by a left strap portion and a right strap portion, and the connection of the ends of the left and right portions of the rear strap to the shell is made by means of an intermediate connecting piece having the shape of an inverted Y.

Furthermore, according to an alternative embodiment of the protective helmet, the rear intermediate connecting piece is semi-rigid, and it is journaled about its point of fastening to the shell in a transverse plane orthogonal to the longitudinal plane of symmetry, so as to be able to assume the shape of the nape of the user's neck.

According to another characteristic of the protective helmet according to the invention, the chin strap has at least one self-connecting and self-disconnecting buckle, this automatic buckle, and more particularly the connecting zone, being arranged at the point of convergence of the left portion of the front strap with the left portion of the rear strap.

BRIEF DESCRIPTION OF DRAWINGS

Other characteristics and advantages of the invention will become apparent from the following description, with reference to the annexed drawings which are only provided as non-limiting examples.

FIGS. 1–12 show the preferred embodiment of the protective helmet according to the invention;

FIG. 1 is a perspective view of the helmet of the invention;

FIG. 2 is a left side elevation view;

FIG. 3 is a right side elevation view;

FIG. 4 is a front elevation view;

FIG. 5 is a rear elevation view;

FIG. 6 is a side elevation view, with the shell of the helmet being shown in longitudinal cross section;

FIG. 7 is an exploded view of the helmet;

FIG. 8 is a view illustrating the chin strap alone in an extended position;

FIG. 10 is a detailed view of the rear strap portions in a cross-section taken along the line B—B; and FIGS. 11 and 12 show how the quick adjustment system for the head-band is obtained.

DETAILED DESCRIPTION OF THE INVENTION

Figure 1:
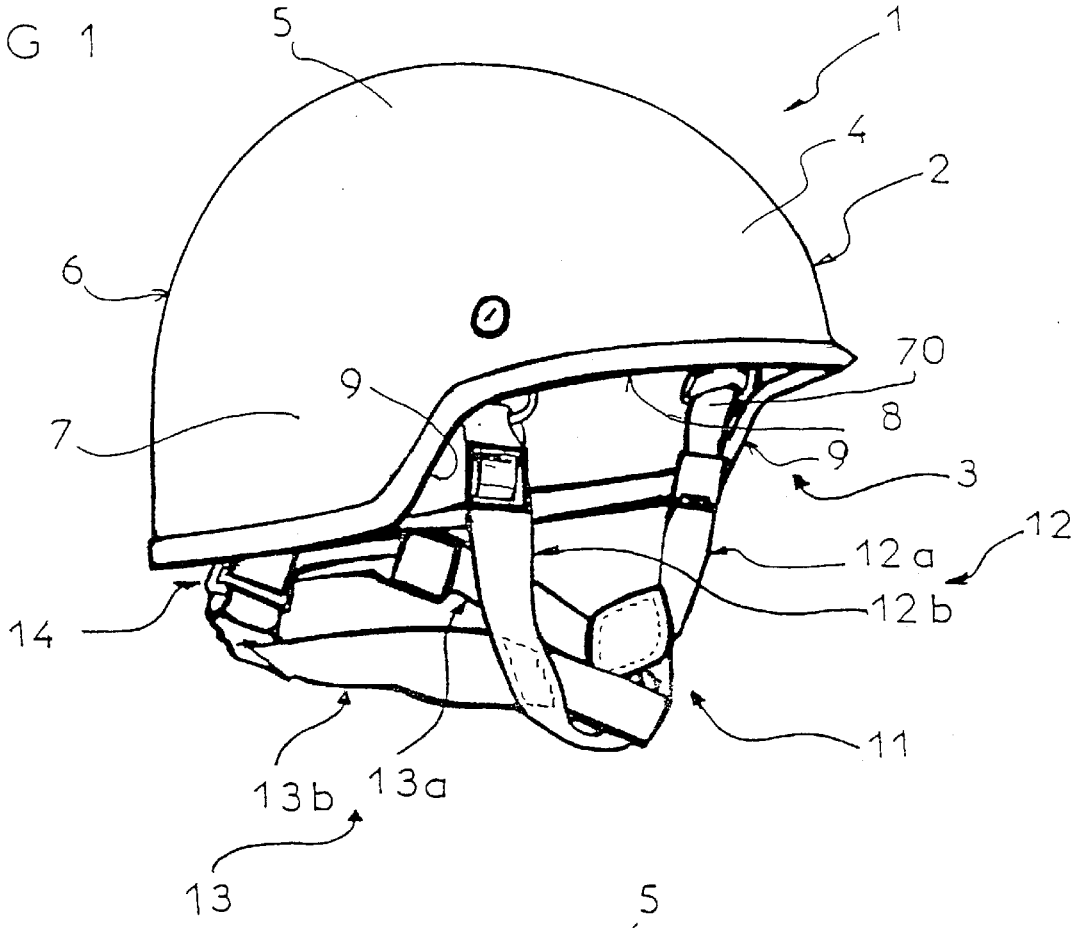

The protective helmet designated generally by the reference numeral 1 in FIGS. 1–12, by way of example, is shown particularly as a soldier's helmet, of the infantry type, which has a general longitudinal plane of symmetry P which includes, in a known manner, a main outer shell 2 having a facial opening 3.

The main outer shell 2 is constituted by a substantially spherical wall having a general vertical plane of symmetry P, which is advantageously made of a composite material including a stack or lamination of layers of reinforcing fibers impregnated and tied to one another by a resin matrix. The fibers can be glass, aramid, nylon, polyethylene, or carbon fibers, whereas the matrix can be a plastic of the thermo-hardening or thermoplastic type. Of course, the shell could be made of any other material, such as steel.

Figure 3:
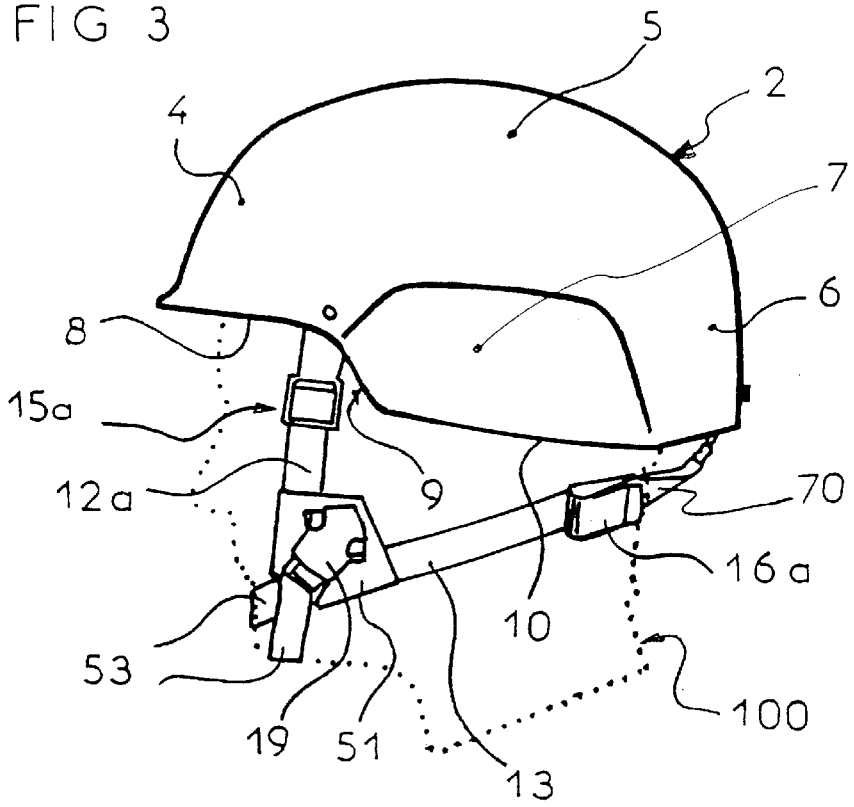

The main outer shell 2 has a plurality of wall portions, as shown in FIG. 3, namely an upper front wall portion 4 extended rearwardly by an upper rear wall portion 5, itself extended downwardly by a lower rear wall portion 6, and further has two lateral wall portions 7. The upper front portion 4 corresponds to the zone occupied by the user's forehead, and is limited by the upper edge 8 of the facial opening 3 which is itself laterally limited by two lateral edges 9. The upper rear wall portion 5 corresponds to the zone occupied by the user's skull, whereas the lower rear wall portion 6 corresponds to the zone occupied by the nape of the user's neck. Additionally, the wall of the shell is limited downwardly by a lower edge 10. The lateral wall portions 7 correspond to the zones occupied by the user's ears, and are limited forwardly by the corresponding lateral edge 9 of the facial opening 3, and downwardly by the lower edge 10.

Figure 7:
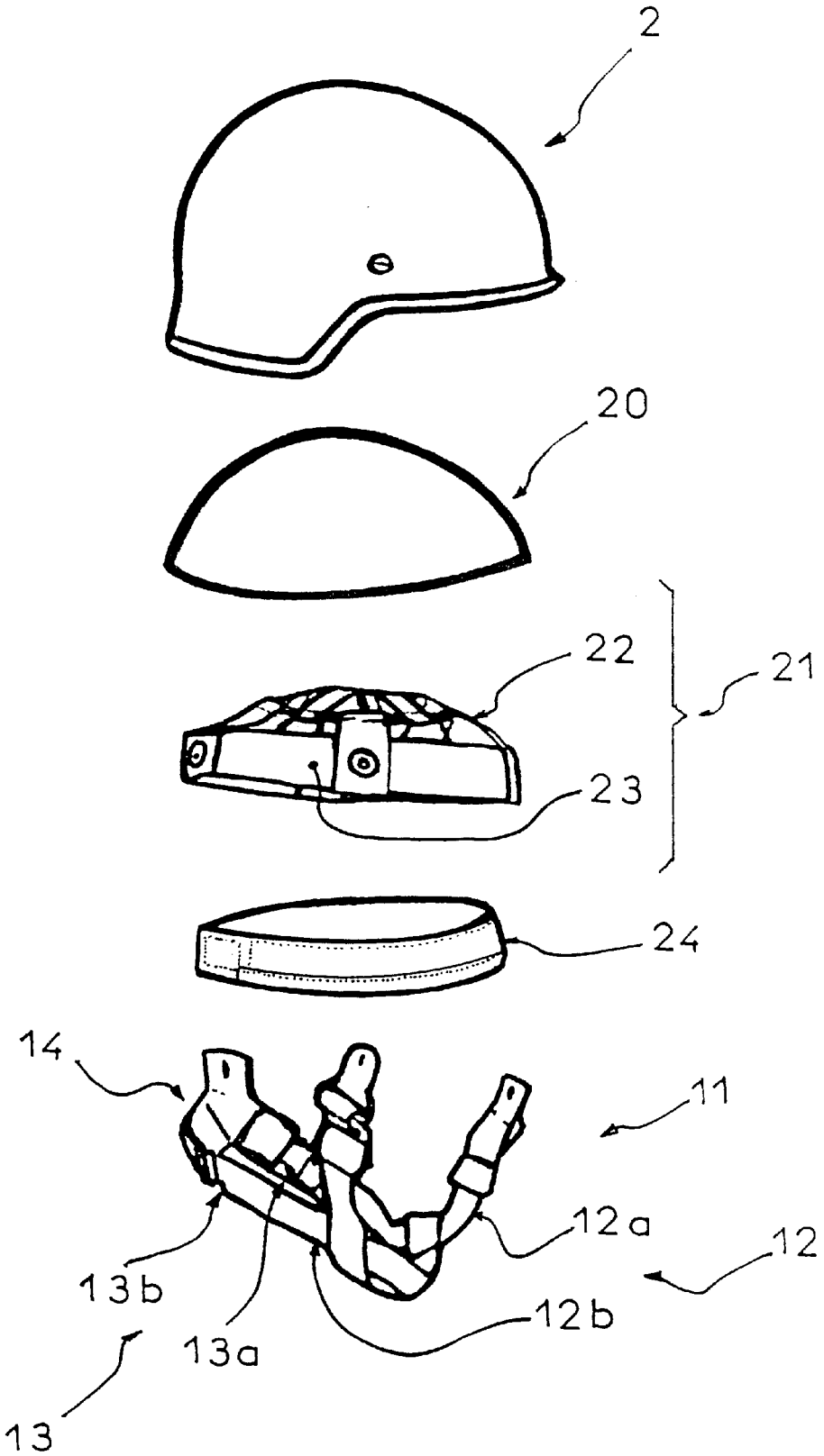
Figure 8:
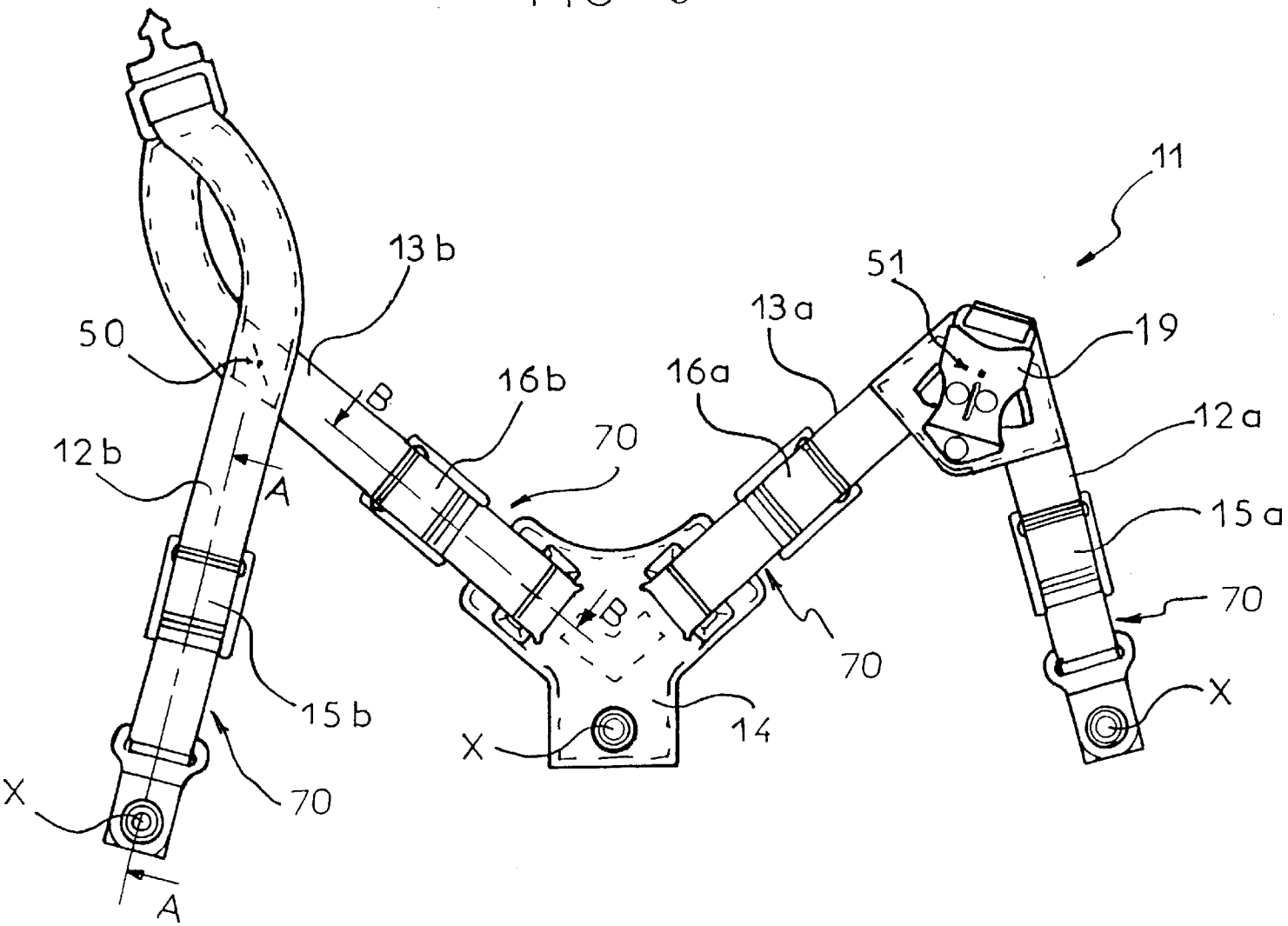

Furthermore, as shown in FIG. 7, the inner enclosure of the main shell 2 has a dome 20 constituted, for example, by a foam layer adhered to the inner surface of the shell, as well as a deformable cap 21 intended for the adaptation of the helmet to the volume and shape of the user's head. The deformable cap is, for example, constituted by a set of elements 22 made of flexible materials, such as leather, strap or the like, retained on a cap support 24 fixed to the shell 2.

According to the invention, the protective helmet 1 has an arrangement for holding and positioning, adapted to allow it to be adjusted and fastened to the user's head 100, such arrangement having a chin strap 11 and a head-band 23 for adjusting the deformable cap 21. The chin strap 11 is constituted by a set of flexible straps, namely, a front strap 12 and a rear strap 13 joining one another in their middle portion. The head-band 23 is arranged in the cap 21 so as to enable the adjustment of the user's head within the cap.

According to the invention, the holding arrangement includes an adjustment mechanism for adjusting the length of the straps 12, 13, the adjusting mechanism having at least one pulley-type device 70 constituted by a lever buckle 15, 16 arranged on the strap and by a complementary return buckle 18.

Figure 2:
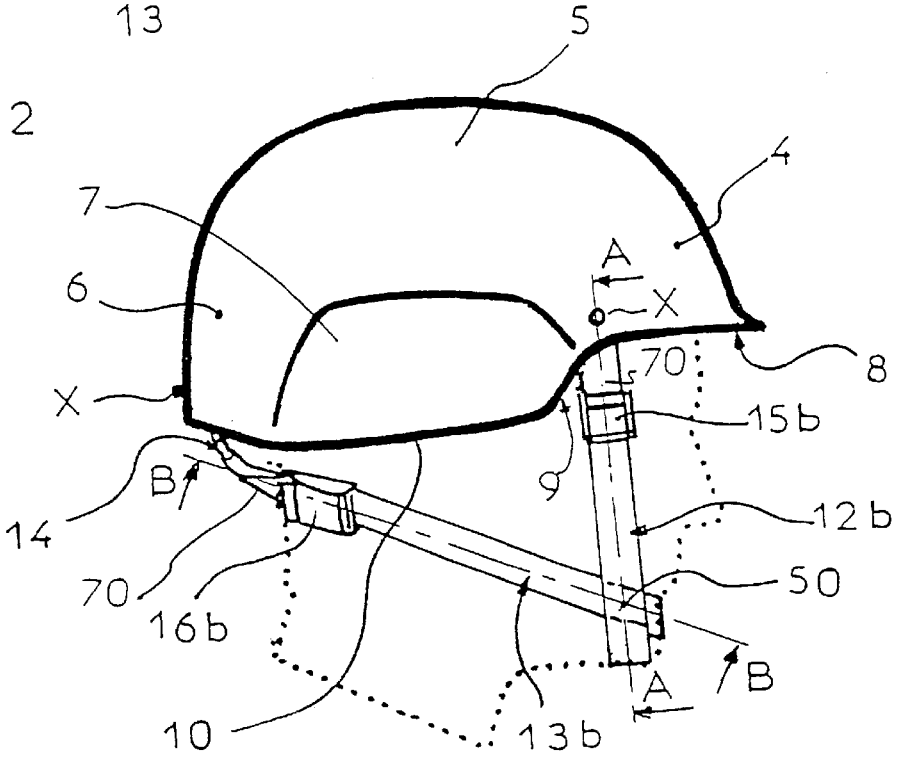

According to the preferred embodiment of the helmet 1 and of its chin strap 11, the front strap 12 is constituted by a left portion 12*a* of the front strap, and by a right portion 12*b* of the front strap, whereas the rear strap 13 is constituted by a left portion 13*a* of the rear strap, and by a right portion 13*b* of the rear strap, as shown in FIGS. 2 and 3.

According to a particular feature of the illustrated embodiment of the invention, the ends of the left 12*a* and right 12*b* portions of the front strap 12 are fixed to fastening points X at the upper edge of the facial opening, in the vicinity of the lateral edges 8 of the main outer shell, whereas the ends of the left 13*a* and right 13*b* portions of the rear strap 13 are fixed to the center and to the rear of the lower edge 10.

Figure 4:
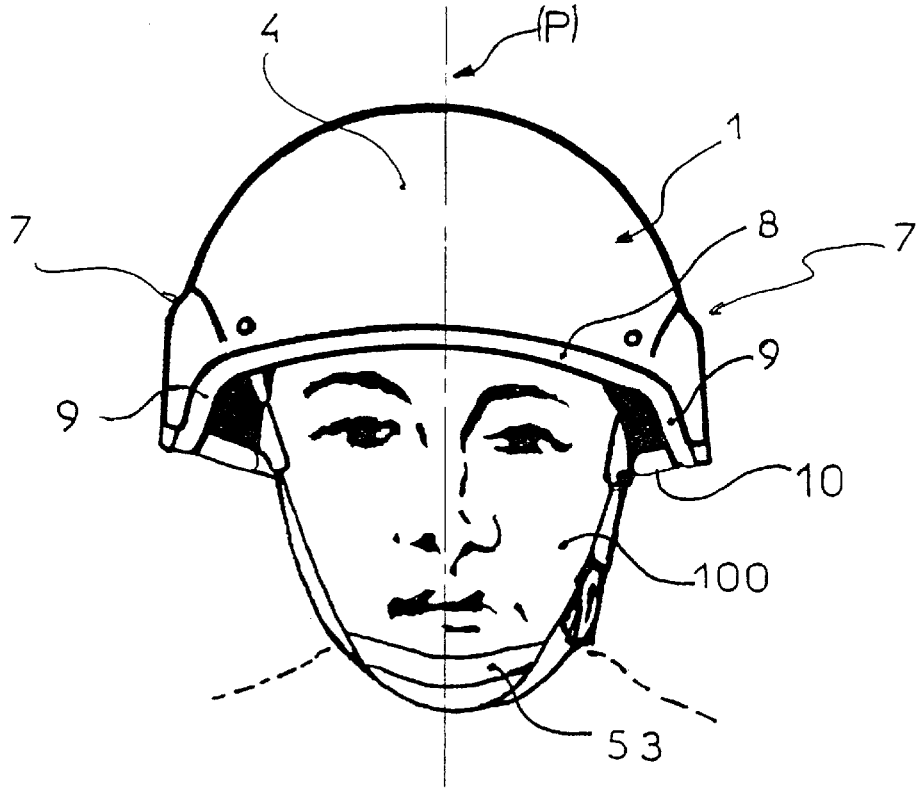
Figure 6:
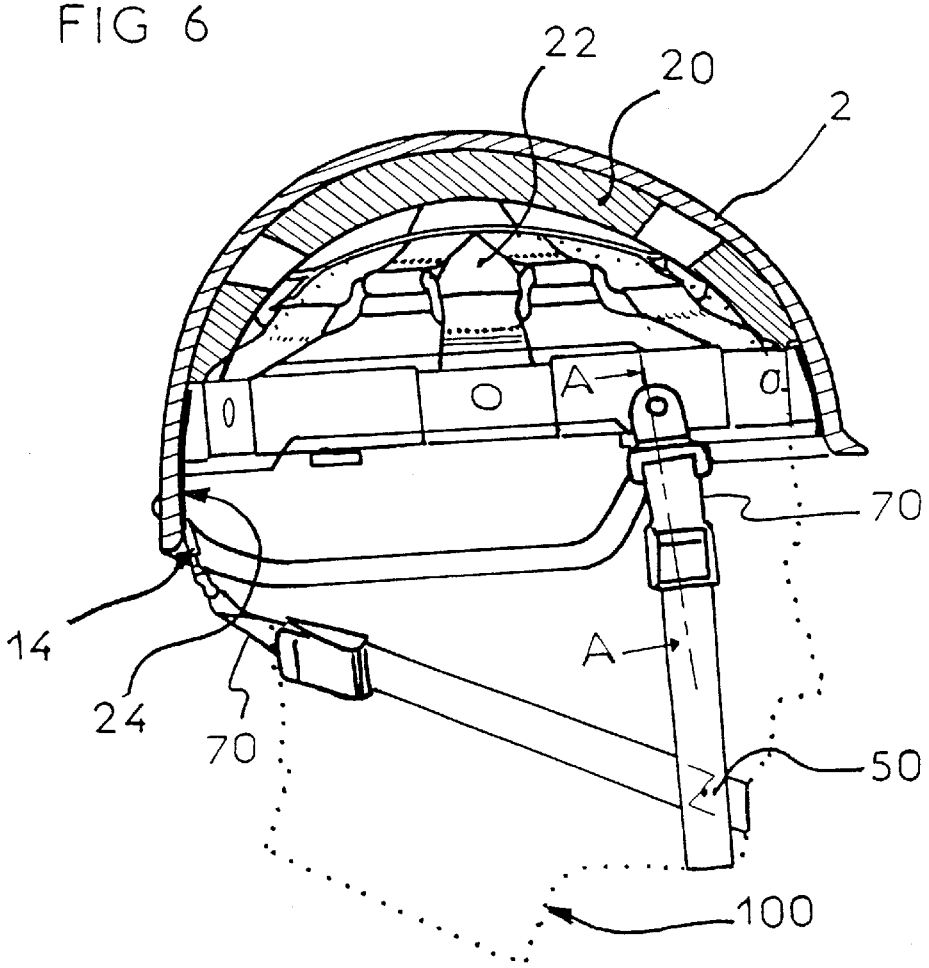

Furthermore, the other ends of the right portions 12*b*, 13*b* of the front and rear straps are fixed together at a point of convergence 50, the ends of the left portions respectively joining one another at the point of convergence 51. The two points of convergence 50, 51 are advantageously adapted to be connected to one another by one or more complementary strap portions 53 adapted to pass beneath the chin, or to surround the user's chin to fasten the helmet 1, as shown in FIG. 4.

Moreover, the chin strap 11 can be opened to enable the positioning of the helmet, and closed to ensure the retention thereof on the user's head. To this end, the chin strap has at least one self-connecting and self-disconnecting buckle 19 adapted to enable the release of the complementary strap portions 53. According to one advantageous arrangement, this automatic buckle and, more particularly, the connecting zone, is arranged at the point of convergence 51 of the left portion 12*a* of the front strap 12 with the left portion 13*a* of the rear strap 13, as shown in FIG. 3.

According to the preferred embodiment of the protective helmet according to the invention, each of the strap portions has length adjustment mechanism, as shown in FIGS. 2 and 3.

Thus, the left portion 12*a* of the front strap 12 has a length adjustment mechanism 15*a*, and the right portion 12*b* of the front strap 12*b* also has a length adjustment mechanism 15*b*. Likewise, the left portion 13*a* of the rear strap 13 has an adjustment mechanism 16*a*, and the right portion 13*b* of such strap also has a length adjustment mechanism 16*b*.

Each of the strap portions 12*a*, 12*b*, 13*a*, 13*b* is a continued portion with a finite length connecting a point of convergence 50, 51 to a hooking point affixed to the main outer shell 2. Their adjustment mechanisms 15*a*, 15*b*, 16*a*, 16*b*, shown particularly in FIGS. 9*a*, 9*b*, and 10, are each constituted by an assembly of a lever buckle 15, 16 and a complementary return buckle 18 which form a sort of pulley 70, enabling the adjustment of the useful length of the respective strap portions on which they are arranged.

Figure 9A:
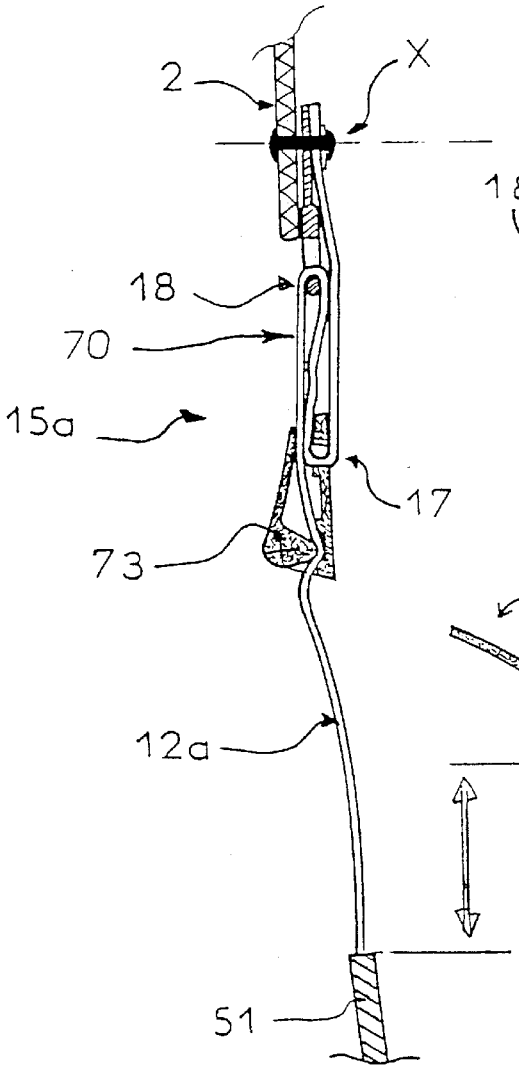
FIGS. 9*a* and 9*b* are detailed views of the front strap portions in a crosssection taken along the line A—A, the adjusting mechanism respectively being in different adjusting positions.
Figure 9B:
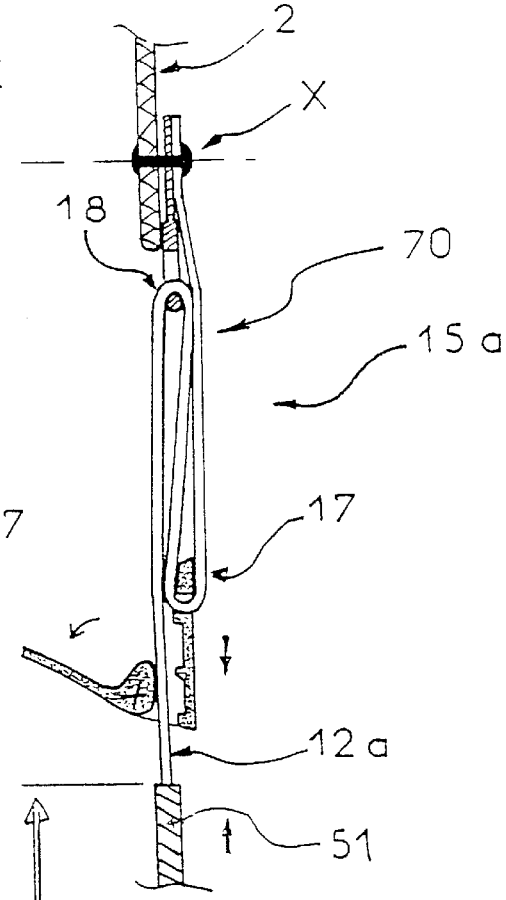
Figure 10:
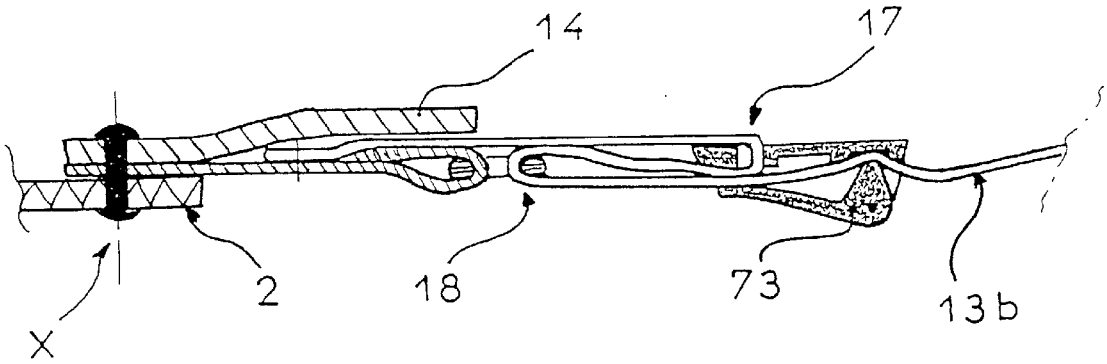

Thus, it is noted that the strap portion 12*a*, 12*b*, 13*a*, 13*b* extends from its attachment point, passing through a buckle 17 of the lever buckle 15, 16, before coming back to pass through the complementary return buckle 18 affixed to the attachment point and fixed with respect to the latter; it then slides under the pivoting lever arm 73 of the lever buckle 15, 16 so as to be capable of being blocked by the latter in a known manner, as shown in FIGS. 9*a* and 10. It is noted that FIG. 9*b* shows the sliding of the lever buckle 15*a* so as to bring it into a different adjusting position than that shown in FIG. 9*a*, the pivoting lever being in an open position allowing the sliding.

In order to obtain a better positioning of the protective helmet 1 on the user's head 100, the connection of the ends of the left and right portions of the rear straps to the shell occurs due to an intermediate connecting piece 14 having the shape of an inverted Y.

Figure 5:
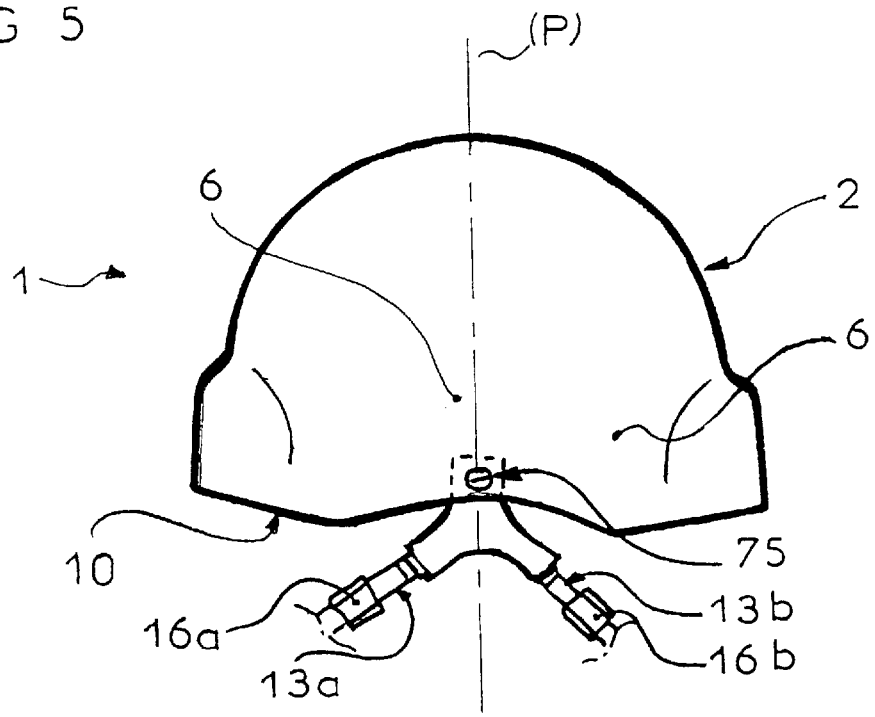

As shown in FIG. 5, the connecting piece 14 is fixed on the rear lower portion 6 of the main outer shell 2 of the helmet 1, in the vicinity of the lower edge 10; it is advantageously journaled about its fastening point X, 75, in a transverse plane orthogonal to the longitudinal plane of symmetry P. The connecting piece is advantageously obtained by assembling two Y-shaped pieces, one external piece being made of a semi-rigid material, such as a relatively hard leather, and one internal piece adapted to take support at the top of the nape of the user's neck, and made of a relatively soft material, such as a padding in a soft leather envelope.

The assembly of the internal and external pieces is carried out with stitches which particularly enable a solid and reliable fastening of the rear portions 13*a,* 13*b* of the rear strap and of the complementary return buckles 18 on the connecting piece 14. It is noted that the connecting piece thus constituted is semi-rigid and therefore susceptible to bending slightly and pivoting about its fastening point so as to be capable of assuming the shape of the nape of the user's neck.

Figure 11:
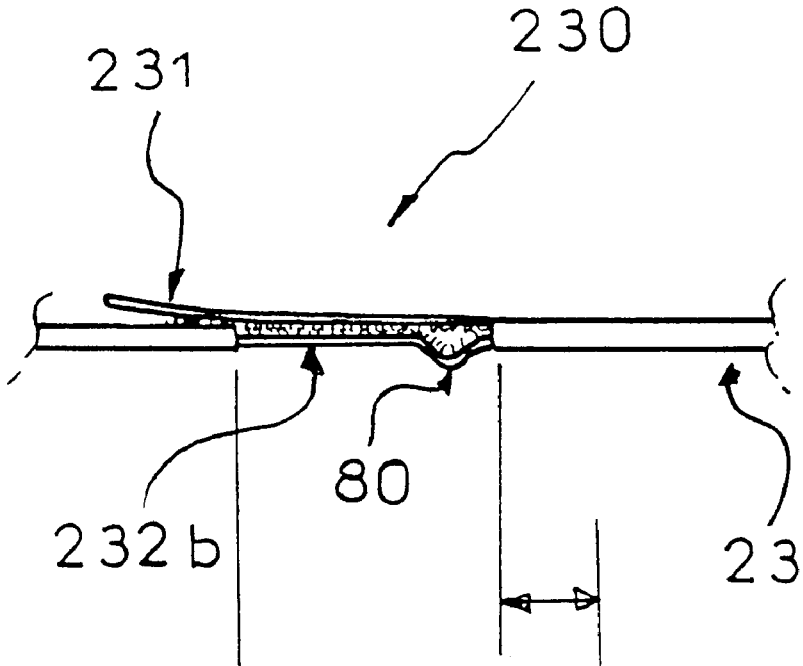
Figure 12:
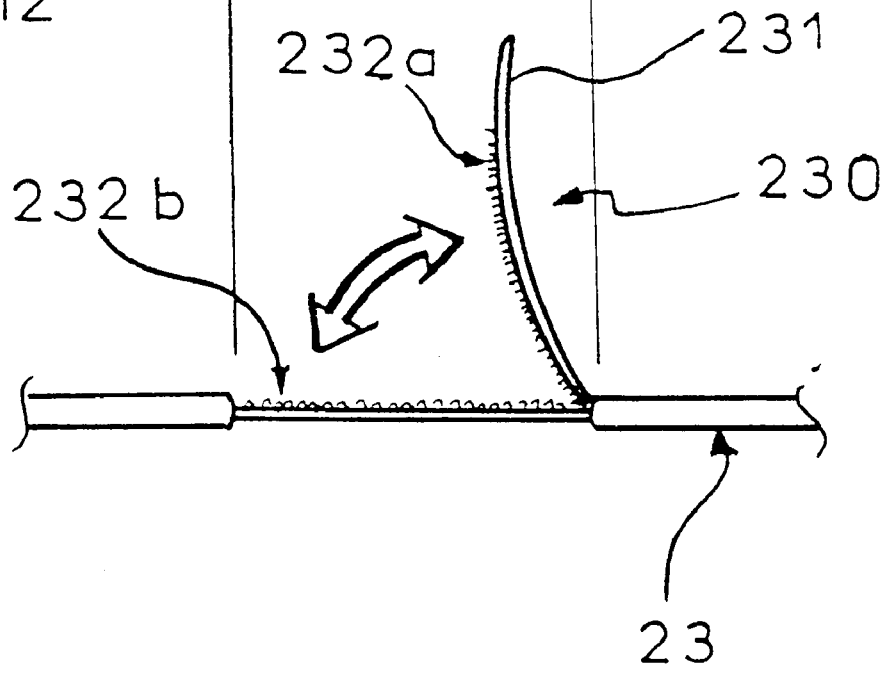

According to the preferred embodiment of the protective helmet according to the invention, the holding and positioning arrangement of the helmet includes an adjusting headband 23 arranged in the deformable cap 21 adapted to encircle the user's head. The headband has a quick adjustment system 230 adapted to facilitate use, for example, with a gas mask. The adjustment system makes it possible to further widen the headband without modifying the main adjustment of the headband. To this end, a movable covering tongue 231 affixed to the headband is provided, which includes one of the parts 232*a* of a self-gripping device, i.e., one part of a hook and loop fastening mechanism, such as Velcro, as shown in FIGS. 11 and 12. A corresponding self-gripping part 232*b* is arranged on the headband, also shown in FIGS. 11 and 12. Thus, the tongue can be completely released by disengaging the self-gripping parts, as shown in FIG. 12, and thus increase the length of the headband. In the initial closed position shown in FIG. 11, the two self-gripping parts partially overlap one another, a portion 80 of the self-gripping part 232*b* being folded, in order to enable the enlargement of the headband.

Furthermore, it is important to note that the headband also has an adjustment adapted to enable the adjustment of the initial position of the headband, such adjustment being able to be constituted, in a known manner, by a self-gripping device located on each of the two ends of the headband. Once the initial adjustment is made, the quick adjusting system makes it possible to enlarge the circumference of the headband without modifying the initial adjustment thereof.

All of the different characteristics, namely, the pulley devices, the rear connecting piece, the adjusting mechanism arranged on each of the strap portions, the specific configuration of the chin strap, as well as the quick adjustment of the headband, contribute to substantially improving the comfort and positioning of the helmet, and to facilitating its positioning. However, each of these characteristics is itself susceptible of constituting an invention.

Of course, the invention is not limited to the embodiments described and shown by way of examples, but it includes all the technical equivalents as well as their combinations.

The instant application is based upon French Application Nos. 98 01867, filed on Feb. 9, 1998, and 98 08972, filed on Jul. 8, 1998, the disclosures of which are hereby incorporated by reference thereto in their entireties, and the priorities of which are hereby claimed under 35 USC 119.

What is claimed is:

1. A protective helmet partially formed by a main outer shell having a longitudinal plane of symmetry, said helmet comprising a holding and positioning arrangement adapted to be fastened to a user's head, said arrangement comprising a set of flexible straps, said holding and positioning arrangement comprising a mechanism for adjusting the length of the straps, said mechanism including a pulley device, said pulley device comprising a lever buckle arranged on the straps and a complementary return buckle, wherein the straps are affixed to the main outer shell, and starting from the point where they are affixed to the main outer shell, pass through a guide of the lever buckle, then come back to pass in the complementary return buckle, before slidably passing again beneath a pivoting lever arm of the lever buckle, that is susceptible of blocking said slidable passing.

2. The protective helmet according to claim 1, wherein the holding and positioning arrangement comprises a chin strap constituted by a set of flexible straps, the chin strap thus being constituted by a front strap and a rear strap joining one another in a middle portion, wherein the front strap is constituted by a left portion of the front strap and of a right portion of the front strap, and the rear strap being constituted by a left portion of the rear strap and by a right portion of the rear strap, the left portions being joined at a point of convergence, while the right portions are also joined at a point of convergence, said points of convergence being adapted to be connected to one another to fasten the helmet.

3. The protective helmet according to claim 2, wherein each of the strap portions comprises a length adjustment mechanism.

4. The protective helmet according to claim 2, wherein each of the mechanisms for adjusting the strap portions includes a pulley device, said pulley device comprising a lever buckle arranged on the straps and a complementary return buckle.

5. The protective helmet according to claim 1, wherein the complementary return buckle is affixed to the main outer shell of the helmet in an area adjacent to where the straps are affixed to the shell.

6. The protective helmet according to claim 1, wherein the set of flexible straps comprises a front strap and a rear strap that is formed by a left strap portion and a right strap portion, and wherein the connection of the ends of the left and right portions of the rear strap to the shell is made at an intermediate connecting piece having the shape of an inverted Y.

7. The protective helmet according to claim 6, wherein the intermediate connecting piece of the rear strap is semi-rigid, and wherein it is journaled about its point of fastening to the shell in a transverse plane orthogonal to the longitudinal plane of symmetry, so as to be able to assume the shape of the nape of the user's neck.

8. The protective helmet according to claim 2, wherein the chin strap comprises at least one self-connecting and self-disconnecting buckle, said self-connecting and self-disconnecting buckle being arranged at the point of convergence of the left portion of the front strap with the left portion of the rear strap.

* * * * *